United States Patent [19]

Merkel

[11] 4,097,941

[45] Jul. 4, 1978

[54] EMERGENCY COT WITH SPRING-BIASED RETRACTABLE WHEEL CARRIAGE

[76] Inventor: Jerome L. Merkel, P.O. Box 674, Bayfield, Wis. 54814

[21] Appl. No.: 797,744

[22] Filed: May 17, 1977

[51] Int. Cl.[2] ..... A61G 1/02; A61G 7/08

[52] U.S. Cl. ..... 5/81 R; 5/63; 5/82 R; 5/86; 108/144; 296/20

[58] Field of Search ..... 5/81 R, 81 B, 82 R, 5/86, 60, 63; 296/20; 108/144, 145, 146

[56] References Cited

U.S. PATENT DOCUMENTS

| | | | |
|---|---|---|---|
| 2,833,587 | 5/1958 | Saunders | 5/81 R |
| 2,958,873 | 11/1960 | Ferneau | 296/20 |
| 2,977,168 | 3/1961 | Johnson | 108/145 |
| 3,245,366 | 4/1966 | Fox | 108/145 |
| 3,644,944 | 2/1972 | Bourgraf et al. | 5/86 |
| 3,805,712 | 4/1974 | Taylor et al. | 248/401 |

*Primary Examiner*—Paul R. Gilliam
*Assistant Examiner*—Alex Grosz
*Attorney, Agent, or Firm*—Clarence A. O'Brien; Harvey B. Jacobson

[57] ABSTRACT

An emergency cot for transporting patients and the like includes a basic patient supporting frame structure of conventional type having supporting wheel structure mounted on a wheel carriage which is connected to the frame support of the cot by suitably collapsing linkage to permit the wheels to be collapsed against the cot with an overall height of approximately one foot, or dropped away from the cot so as to support same at approximately waist level of the attendants using same to transport the patient. An important feature of this device is in spring biased mechanism which may be suitably energized by an attendant operating a pull cable either side of the cot structure to compress dual springs and latch same in compressed position. Then upon release of a wheel carriage latch mechanism, the compressed springs will automatically raise the wheels to the collapsed position. Thus, the attendants transporting a patient need not lower the cot to collapse the wheels, but they merely release the latch mechanism and the wheels will automatically be collapsed due to the biasing of the compressed springs of this mechanism. A further actuation mechanism de-latches the compression spring mechanism upon termination of the collapse cycle so that the carriage may again be operated for free fall of same when the latch mechanism is again released. Dampening structure of both hydraulic and pneumatic type also is provided to slow the rate of carriage collapse.

20 Claims, 14 Drawing Figures

EMERGENCY COT WITH SPRING-BIASED RETRACTABLE WHEEL CARRIAGE

BACKGROUND OF THE INVENTION

1. Field of the Invention

This invention relates generally to devices for transporting patients consisting of emergency cot devices with collapsible and retractable wheel carriage structure, and especially to automatic wheel carriage retraction mechanism for such cots.

2. Description of the Prior Art

A common problem with known type emergency cots having collapsible wheel carriage structure is that while such carriage structure will drop upon release of an appropriate latch mechanism by an attendant supporting the cot and patient thereon, generally the only way to retract and collapse said wheel carriage structure is to lower the patient and supporting cot against the connecting struts of the wheel carriage with the latch mechanism held in the release position. Thus, effectively the weight of the patient with the latch mechanism held in release position will effect the collapse of the lower side of the cot frame work against the upper portion of the wheel carriage. This manner of collapsing is undesirable because the patient's head generally is put into an ambulance first and when the cot and patient are lowered to collapse the support structural wheel carriage, it places the patient's head quite close to the ambulance's exhaust. Normally, the ambulance engine is kept running, especially in winter when it is desired to keep the engine and interior warm, and thus the patient is exposed to the toxic fumes of carbon monoxide, etc. from the exhaust.

Another problem with known type devices for collapsing emergency cot wheel carriage structure is that they are not automatic, or even semi-automatic , in operation.

Another problem with known type devices is that they are unduly complicated and require frequent maintenance. Furthermore, the component parts are expensive and often times difficult to obtain when repairs are necessary.

Known prior art patents which may be pertinent to this invention are as follows: U.S. Pat. Nos. 2,958,873 Nov. 8, 1960 2,977,168 Mar. 28, 1961 3,245,366 April 12, 1966 3,644,944 Feb. 29, 1972 3,805,712 April 23, 1974

None of these known prior art devices offers the new and unique features of the invention disclosed herein.

SUMMARY OF THE INVENTION

An object of the present invention is to provide an emergency cot with a spring-biased retractable wheel carriage structure.

Another object of the present invention is to provide an emergency cot which will function in a conventional manner to permit the retracted wheel carriage structure to free fall when desired, but will permit actuation or cocking of spring biased mechanism for the purpose of semi-automatically retracting the wheel carriage structure when desired by users of the cot.

Another object of this invention is to provide an emergency cot with spring-biased retractable wheel carriage structure together with wheel carriage counterbalance spring mechanism as well as fluid or pneumatic shock absorbing features.

A still further object of this invention is to provide emergency cot structure having wheel carriage weight counterbalance mechanism together with dampening means for the movement of the wheel carriage structure together with cockable spring compression structure for semi-automatic retraction of the wheel carriage when an operator controlled latch mechanism is released. Also, once the automatic retraction of the wheel carriage structure has been effected, the compressed spring bias structure is automatically deactivated ready for the next free fall extension of said wheel carriage structure under operator control.

The emergency cot with spring-biased retractable wheels of this invention has a number of new and unique features. The all-level cot device provides quick and easy patient transfer under numerous different circumstances. The cot may be quickly adjusted to a number of different height levels with a simple side or end hand release mechanism, which allows the operators or attendants to raise or lower the cot to the height of a bed or table in seconds and still keep both feet on the ground. Also, with this improved structure, the attendants need not lower the cot with a patient thereon towards the ground in order to collapse and retract the wheel carriage structure.The semi-automatic wheel carriage retraction mechanism of this invention permits the attendants to keep the cot and patient at waist-high level and then merely by cocking the spring bias mechanism prior to use thereof, and then upon release of associated latch mechanism the wheel carriage structure will retract to the collapsed position against the lower portion of the cot.

The overall structure is formed of preferably strong tubular aluminum tube material and therefore is relatively light in weight.

In addition to the semi-automatic wheel retraction mechanism, additional features include counterbalance spring mechanism for nullifying the weight of the wheel carriage structure, together with dampening means which include light weight compression springs, hydraulic oil dampening shocks, or pneumatic shocks. With the pneumatic shocks a check valve is provided which permits air to escape freely during extension of the wheel carriage structure while air enters through a fixed orifice during retraction of the wheel carriage. Thus, in initial free fall of the wheel carriage little if any dampening action occurs, while in retraction maximum dampening occurs.

With the cot structure of this invention, patients may be safely loaded and unloaded into and from ambulances without ever lowering them below the level of the ambulance floor. Likewise, in hospitals and the like the patients always can be held at a waist-level height which psychologically is of benefit to said patients. To be suddenly lowered to the floor, while being handled may be quite disconcerting to some patients, such as heart patients and the like, and with this improved cot structure and mechanism, such need never be done again.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
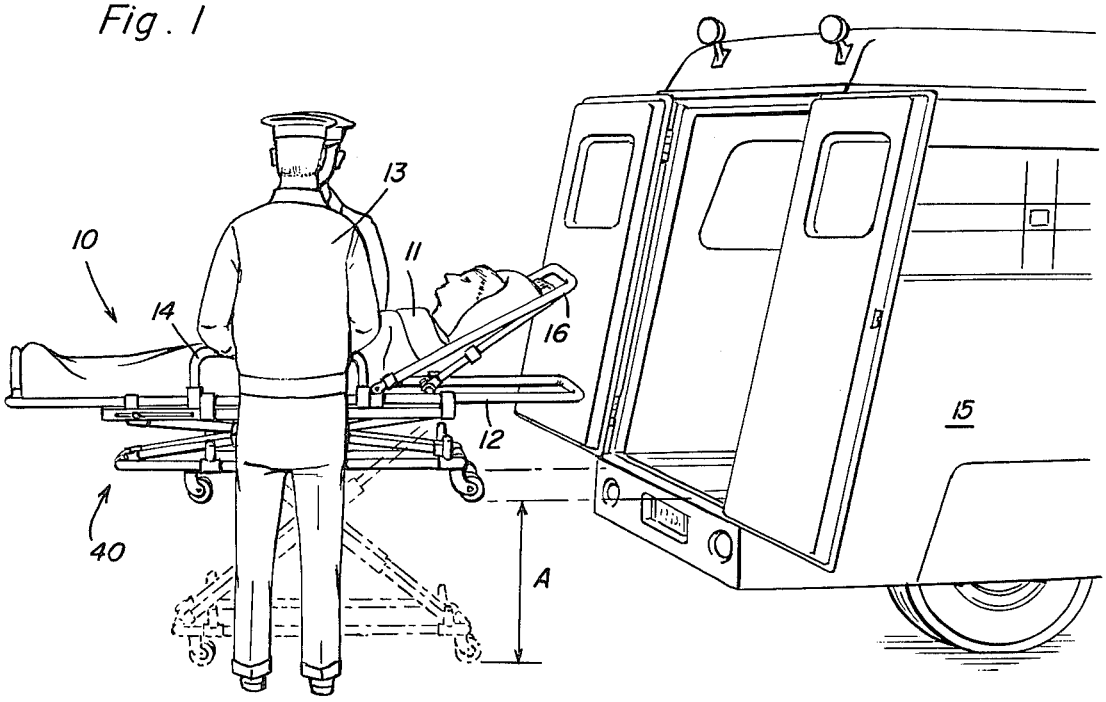
FIG. 1 is a pictorial view of the device of this invention in use.

Referring to FIG. 1 of the drawings, reference numeral 10 indicates in general the emergency cot of this invention as in use for supporting a patient thereon ready to be loaded into an ambulance.

Two attendants are shown which is the normal number used with such a cot, and normally with prior art type devices, the cot with patient thereon must be lowered a substantial distance, indicated by reference A, in order to collapse the wheel carriage indicated in general by reference numeral 40. However, with the device and mechanism of this invention, one or the other of the attendants need merely pull one of the spring bias cocking handles 80 (FIG. 2) to compress the retraction springs into the cock position and to effect automatic latching thereof. Then upon retraction of the wheel carriage latch mechanism by actuation of either the end handle 70 or the side handle 71, the wheel carriage will be positively retracted to the solid line position of FIG. 1. The attendants 13 may then move the cot and patient directly into the ambulance 15 without any stooping or lifting being required on their part. This is advantageous for both the health and welfare of the attendants as well as that of the patient, since the patient never is lowered into the exhaust area of the ambulance.

Figure 2:
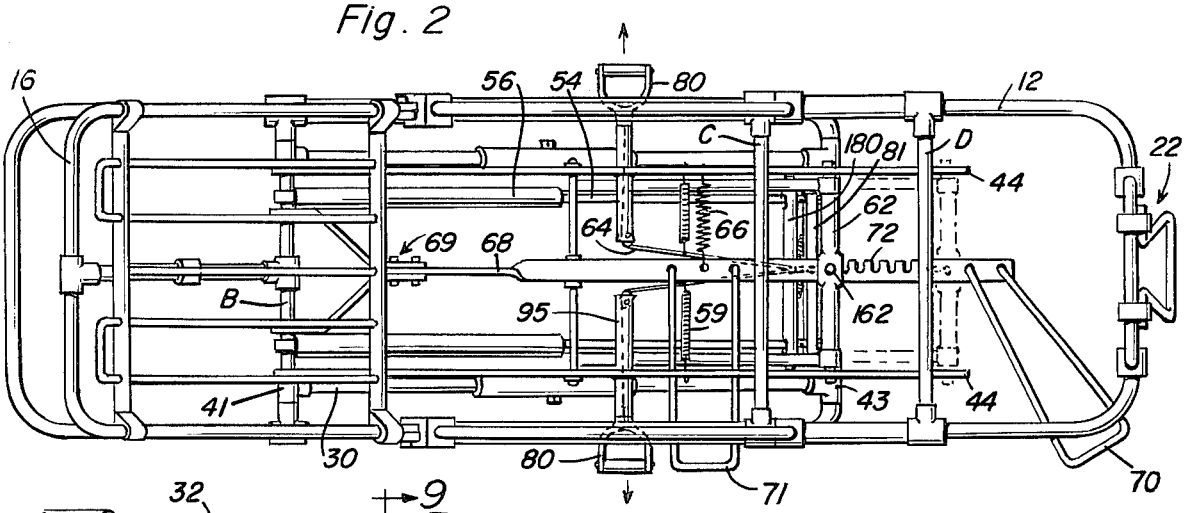
FIG. 2 is a top plan view of the emergency cot of this invention.

Looking at FIGS. 2 and 3, the basic structure of the cot will now be described. A main frame work 12 supports all of the other components therefrom. Side frame members 14 are normally provided as well as an adjustable headrest structure 16 having a telescopic adjusting mechanism 20 therefor. A foot frame structure 22 is also provided. These protect and make the patient 11 more comfortable. Transverse crossbars B, C and D provide strength and rigidity for the frame work as well as supporting members for the wheel carriage support and operation structure.

Figure 3:
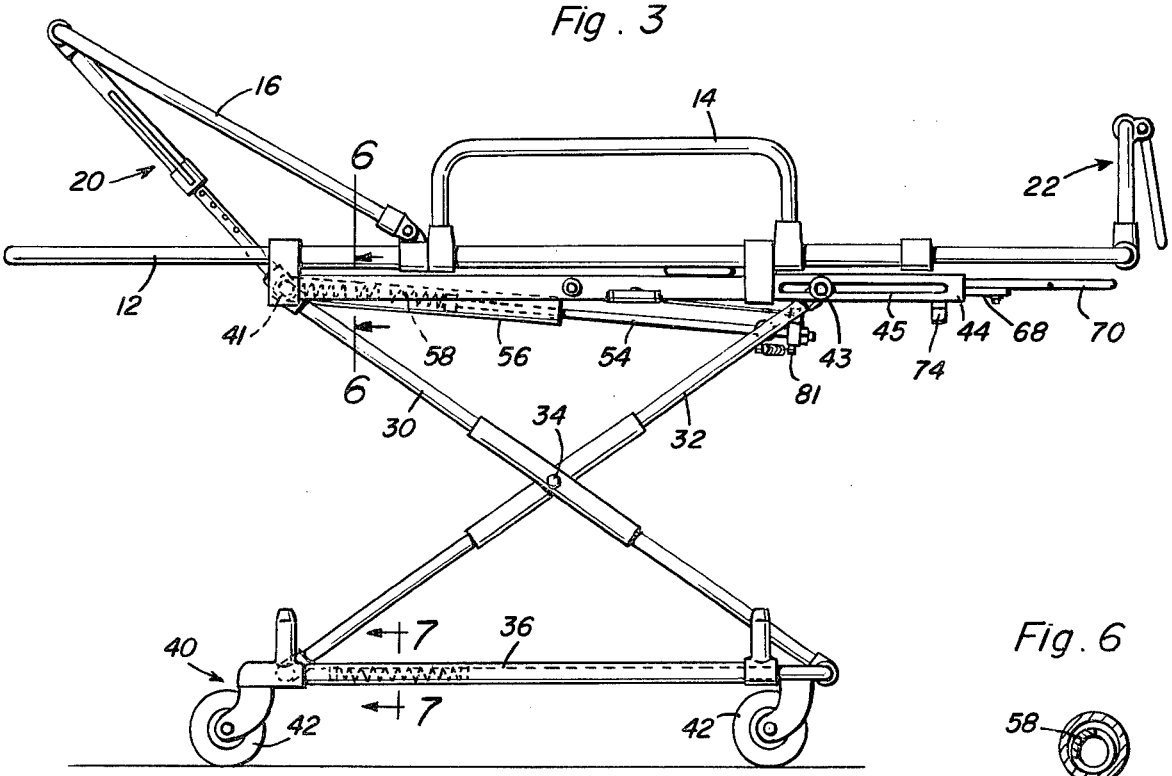
FIG. 3 is a side elevational view of the emergency cot of this invention.
Figure 6:
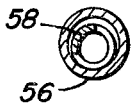
FIG. 6 is an end view, partly in cross section, taken generally along line 6—6 of FIG. 3.
Figure 7:
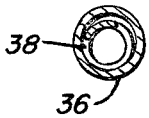
FIG. 7 is an end view, partly in cross section, taken generally along line 7—7 of FIG. 3.
Figure 5:
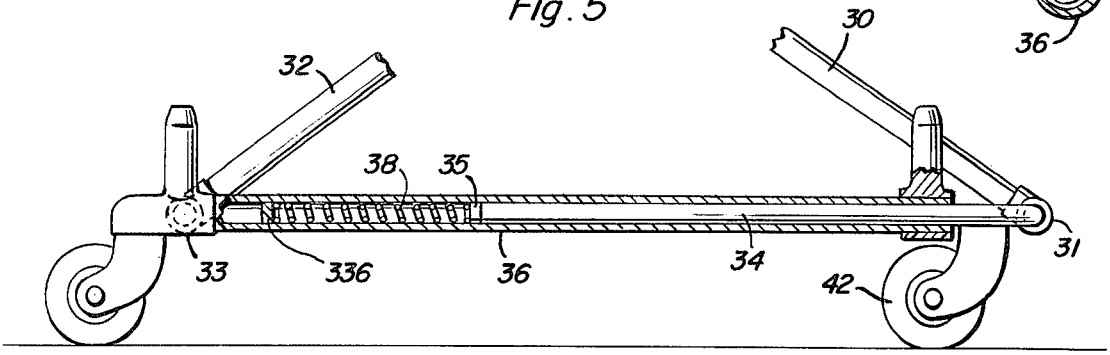
FIG. 5 is an enlarged fragmentary view of the lower portion of the wheel carriage support of FIG. 3.
Figure 11:
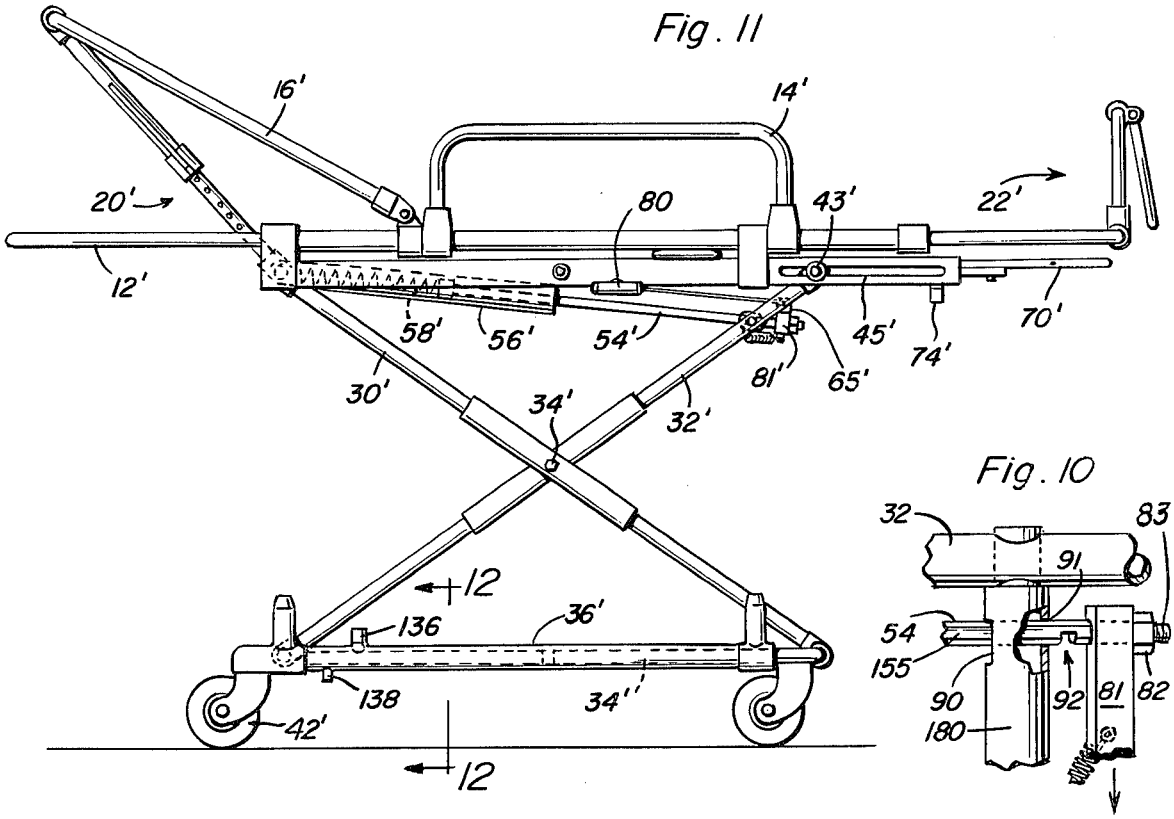
FIG. 11 is a side elevational view of a modified embodiment of the invention.

As can best be seen in FIG. 3, the retractable wheel carriage 40 is generally supported from the cot frame work by means of crossed tubular members 30, and 32 appropriately pivotally connected together by pivot pins 34. The upper end of member 30 is pivotally mounted at 41 from the crossbar B and the tubular member 32 is pivotally mounted at 43 from slidable crossbar 62 which has the ends thereof suitably constrained within slots 45 of the guide channel members 44. It is this pivotal and sliding movement which permits the carriage 40 attached to the lower ends of members 30 and 32 to move toward and away from the cot frame work. Appropriate wheels 42 to support the wheel carriage for rollable movement in a conventional fashion are provided. As best seen in FIG. 5, the lower ends of members 30 and 32 are pivotally mounted to the wheel carriage frame work at 31 and 33. The pivotal connections 31 are mounted on a carriage crossbar which is in turn connected at each end of rods or piston members 34 which telescope into tubular members or cylinders 36 connected to the other carriage crossbar for the pivotal connections 33 of the other leg members 32. The piston member 34 makes a relatively tight sliding fit within cylinder 36 on each side of the wheel carriage. Normally, wheel carriage counterbalance springs 38 are provided between a stop 336 within cylinder 36 and a sliding seal 35 on the end of piston member 34. Normally, hydraulic oil will be contained within the cylinder 36 along the portion containing spring 38 but the quantity thereof is less than the volume of the cylinder 36. This oil provides lubrication for the piston member 34 as well as effecting a dampening action together with the counterbalance weight springs 38 as the fluid flows through a small orifice in stop 336. The springs 38 are normally of approximately 3 pounds compression force. FIG. 7 shows how spring 38 is smaller than the internal diameter of cylinder 36 for free movement therewith.

Figure 9:
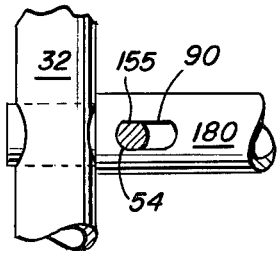
FIG. 9, is an elevational view, partly in cross section, taken generally along line 9—9 of FIG. 8.
Figure 4:
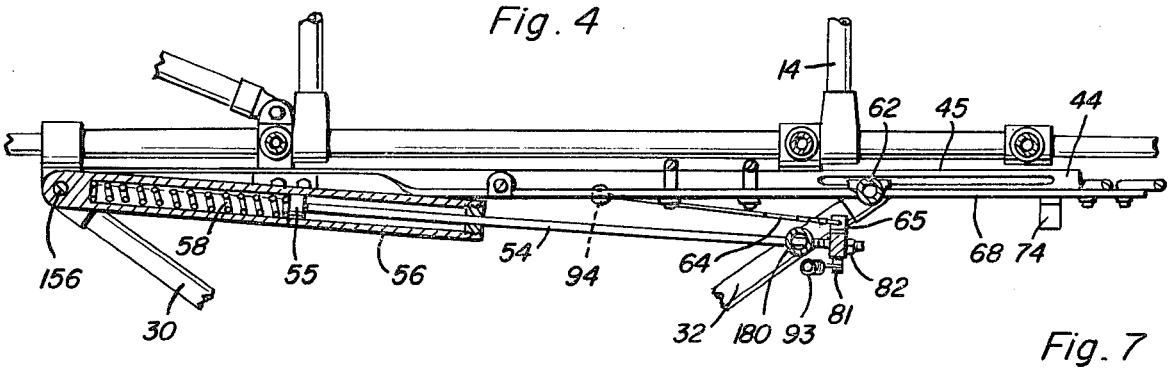
FIG. 4 is an enlarged fragmentary view of the upper portion of the cot frame work of FIG. 3.
Figure 10:
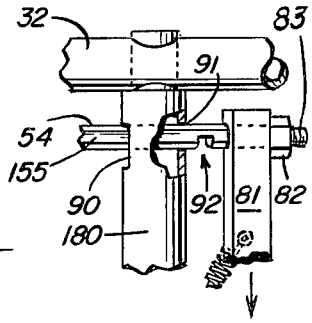
FIG. 10 is a top plan view of the corner portion of the cot in the general area of FIG. 9.
Figure 12:
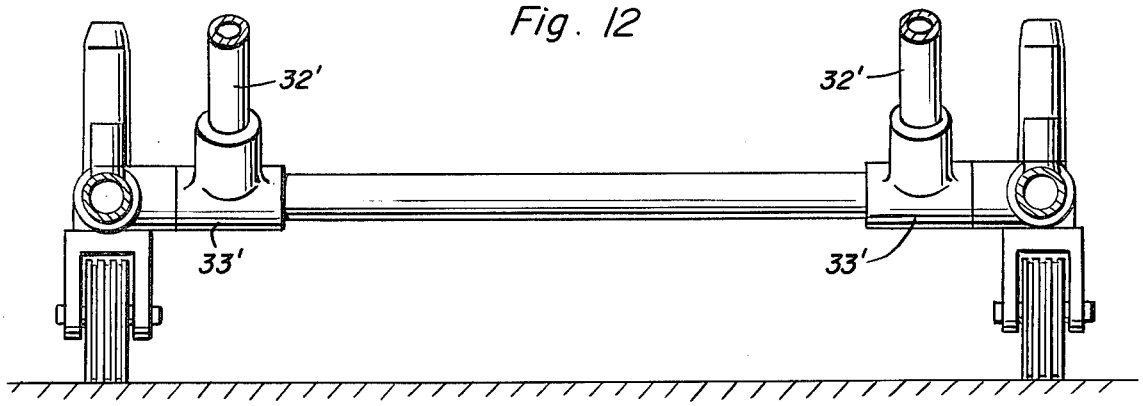
FIG. 12 is an end elevational view, partly in cross section, taken generally along line 12—12 of FIG. 11.
Figure 13:
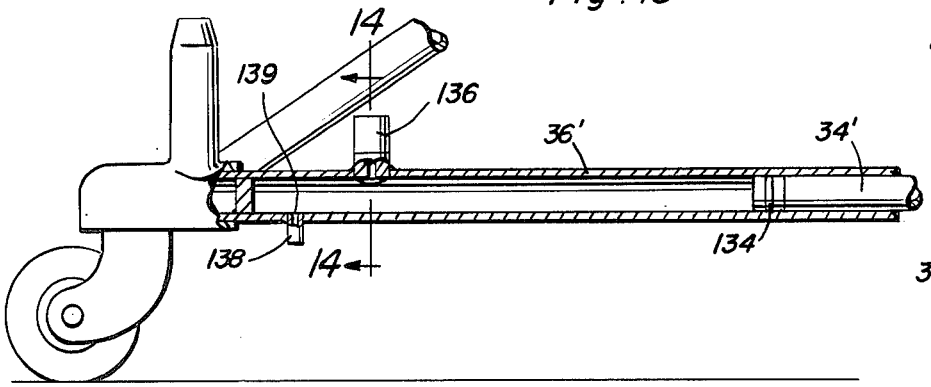
FIG. 13 is an enlarged portion of the lower left corner of the device of FIG. 11.

Looking at FIGS. 3 and 4, the semi-automatic retraction mechanism for the wheel carriage will now be described in detail. Rigid push rods 54 having piston heads 55 provided thereon move within cylinders 56 to provide the power for the automatic retraction mechanism. The cylinders 56 are pivotally mounted at ends 156 while the ends of rigid push rods 54 go through appropriate openings provided in cross member 180. The extreme ends of push rods 54 go through apertures provided in the ends of bar 81 and are secured thereto by hex nuts 82 screwed on threaded ends 83. As best seen in the plan view of FIG. 10, the cross member 180 is provided with an aperture 91 of just slightly larger size than the rod 54 diameter, while the other side of member 180 has a slot 90 provided therein. Each rod 54 also has a recess 92 provided therein. As best seen in the plan view of FIG. 8, both of the rods 54 have their recesses 92 arranged opening in the same direction. The rods 54 have a flat top and bottom surface 155 (see FIG. 9) to prevent twisting or rotation to retain notches 92 in proper relation to the aperture 91. Also, a tension spring 93 interconnects the bar 81 and cross member 180 to assure that notches 92 will be retained in engagement with aperture 91 until released by lug 74 engaging lug 65. As can be visualized by looking at FIGS. 8, 9 and 10, when the rods 54 and the crossbar 81 are moved towards the left by pulling on one handle 80 or the other, an appropriate cable 64 connected to the lug 65 fastened on the top middle of bar 81 will effect this movement. Pulley 94 mounted on the inner ends of rigid support tubes 95 guide cable 64 whereby handles 80 can move bar 81. As the rods 54 move toward the left, compression springs 58 are suitably compressed, and as the recesses 92 come into alignment with the edges of apertures 91, the ends of rods 54 together with bar 81 will move sideways slightly to latch the compression rods 54 with crossbar 180. As thus latched, the compression springs 58 are suitably cocked and ready for a retraction action of the wheel carriage whenever the attendant desires same. The slackness in cable 64 caused when the handles 80 are released after the springs 58 have been compressed is taken up by a light tension spring 59 between cable 64 and frame 44. The compression springs 58 are preferably of approximately 15 pound force, this having been found to be satisfactory for positive retraction of the wheel carriage especially in combination with the counterbalance effect of the lighter springs 38.

Figure 8:
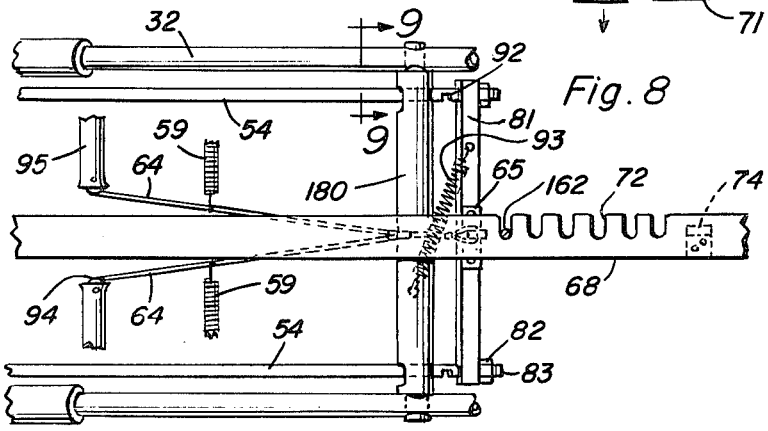
FIG. 8 is a top plan view of the right-hand portion of the cot of FIG. 2.

Looking at FIGS. 2 and 8, the wheel carriage latch mechanism will now be described. A longitudinally supported latch bar 68 is flexibly mounted and supported from the cot frame at 69, and is provided with an end actuating handle 70 and a side actuating handle 71. A light latching spring 66 also is provided. Appropriately provided with the slidably movable crossbar 62, which is mounted at the top of the pivotal support rods 32, is a depending projection 162 which will engage with and be latched by one of the recesses 72 provided in the latch bar member 68. As can be readily visualized, as long as the projection 162 depending from the horizontally movable crossbar 62 is latched, the wheel carriage cannot be either extended or retracted. However, when handle 70 or 71 is moved slightly sideways, whatever latch slot 72 the projection 162 may be in is released therefrom, and movement of the wheel carriage is then permitted. If the compression springs 58 have not been cocked and latched, the wheel carriage will free fall to whatever position is necessary to contact the ground surface, and when the appropriate handle 70 and 71 is released one of the latch slots 72 will again engage with projection 162 and firmly lock crossbar 62 in the position with the wheels extended. This is also the way the cot is adjusted in height. After this, whenever the attendant pulls on one of the handles 80, the compression springs 58 will be suitably compressed and latched in cocked position by means of the crossbar 81, slots 92 in each of the rods 54, and the association therewith with apertures 91 in cross member 180. Thus, with the retraction compression springs 58 suitably compressed and locked in cocked position, whenever the latch mechanism handle 70 or 71 is again moved sideways to release projection 162 depending from crossbar 62 from a latch slot 72, the compression springs 58 will push against the associated rods 54, through slots 92, crossbar 180 and in turn the upper portion of leg members 32 to move their pivot points 43 and cross member 62 longitudinally with the guides 44, 45. This simultaneously will retract the wheel carriage structure 40 to the uppermost position against the lower side of the cot frame work.

Another feature of this structure is in the depending flange 74, best seen in FIG. 4, which is mounted below latch bar 68 and so positioned that it will engage with the upwardly extending flange 65 mounted on crossbar 81. The positioning is such that when the wheel carriage has been completely retracted up against the lower bottom of the cot frame work and the handle 70 or 71 is released, the bias spring 66 moves bar 68 back to the latch position and simultaneously the depending flange member 73 will engage with the upstanding flange member 65 to move the crossbar 81 slightly sideways. The sideways movement is just sufficient to de-latch slots 92 from the edge of apertures 91 provided in crossbar 180. Thus, each time the automatic retraction mechanism is used, and then when the latch mechanism is released, the cocked compression springs are also delatched. Thus, upon the next use of the cot, the attendants may allow the wheel carriage to drop by free fall merely by again actuating either handle 70 or 71. Only by cocking the compression springs and latch mechanism for automatic retraction by the operation of a handle 80 will the mechanism be again ready for automatic retraction of the wheel carriage. Thus, if the compression structure and latch mechanism is not purposely cocked, the wheel carriage will operate freely as if such retraction mechanism were not present. However, the automatic retraction mechanism is ready and available whenever desired to be used.

FIGS. 11–14 show a modified embodiment of the device. In this embodiment, the basic compression spring and retraction mechanism is similar to that already described. Like parts in these Figures are indicated by the same reference numerals as in the previous Figures with a prime added thereafter. In this modification, the counterbalance springs and dampening structure provided for the lower end of the wheel carriage structure has been modified as perhaps can best be seen in FIGS. 11, 13 and 14. The cylinder 36' has been provided at the closed end thereof with a one way check valve 136 which will permit air to escape freely during extension of the legs 30' and 32' which in turn causes movement of piston rod 34' with piston seal 134 thereon to compress air within cylinder 36'. When the wheel carriage is to be retracted either manually or automatically, a dampening effect is achieved by the passage of air in a restricted manner through the fixed orifice 139, 140 provided in protective extension 138.

Figure 14:
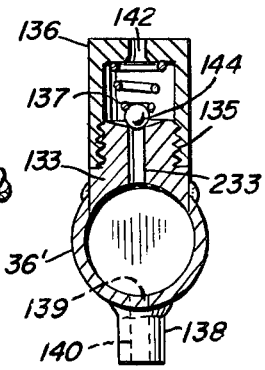
FIG. 14 is an end elevational view, partly in cross section, taken generally along line 14—14 of FIG. 13.

FIG. 14 shows one type of air check valve which may be used. This consists of a projection 133 appropriately welded or otherwise affixed to the cylinder 36' having a central aperture therein 233 to permit air flow out of cylinder 36'. An air check ball 144 suitably bears against a recessed portion around the upper end of aperture 233. A spring 137 normally maintains this ball tightly seated against the air opening. A cover cap 136 holds the other end of spring 137 therewithin and in adjusted position. A central aperture 142 within cover member 136 provides for the escape of the air as compressed within the cylinder 36' and as permitted to escape by check ball 144. The dampening device of this embodiment also functions to limit the speed of operation of the retraction of the wheel carriage structure.

A contemplated further embodiment would be to enclose the dampening device of either embodiments described within the large compression spring cylinder 56 or 56' and thus eliminate the additional hardware in the lower wheel carriage structure. This embodiment and modification has not been shown but it is contemplated as an alternative to the described invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention

What is claimed as new is as follows:

1. In an emergency cot structure including an upper patient-supporting frame, a lower frame, and support members connected between the upper and lower frames for permitting relative extension between the upper and lower frames, the cot structure further including a latch bar mounted to the upper frame and a slidable crossbar pivotally mounted to upper ends of the support members, portions of the slidable crossbar being received in slots in guide channel members mounted to the upper frame for movement therein to allow relative extension between the upper and lower frames, the latch bar being releasably mounted to the slidable crossbar to position the upper frame relative to the lower frame in differing positions, the improvement comprising:

a cross member pivotally mounted to at least one of the support members;

at least one rod member;

means carried by the rod member at one end thereof for engaging a portion of the cross member;

means carried by the cross member for releasably engaging the first-mentioned means on the rod member;

means pivotally mounting the rod member to the upper frame at the other end of said rod member for exerting a force against the rod member to displace the cross member when the first-mentioned means in said rod member is engaged by the second-mentions means carried by the cross member, thereby to displace the slidable cross member within the guide channel members on release of the latch bar from the slidable cross bar.

2. In the improved structure of claim 1, wherein the first-mentioned means comprises a notch and the second-mentioned means comprises a slot, the said one end of the rod member being received through said slot.

3. In the improved structure of claim 2 and further comprising:

means for displacing the rod member to engage the notch in said rod member in the slot formed in the cross member, thereby to dispose the structure in a conformation preparatory to displacement of the lower frame toward the upper frame.

4. In the improved structure of claim 3 and further comprising:

means for releasing the latch bar from the slidable crossbar, thereby to allow the third-mentioned means to exert a force through the rod member against the cross member to displace said cross member and the support members connected thereto for displacing the lower frame the upper frame.

5. In the improved structure of claim 2 wherein the third-mentioned means comprises a cylinder pivotally attached at one end to the upper frame and receiving a second end of the rod member into a second end of the cylinder and a spring disposed within the cylinder for exerting a force against the second end of the rod member.

6. In the improved structure of claim 2 wherein the lower frame further includes wheels mounted to said lower frame.

7. In the improved structure of claim 2 wherein the improvement further comprises dampening means mounted to the lower frame for controlling the rate of relative displacement of the upper and lower frames.

8. In the improved structure of claim 7 wherein the dampening means comprise a cylinder mounted to a lower end of one of the support members and a piston mounted to a lower end of one of the other support members, the piston being received within the cylinder, and force reducing means disposed interiorly of the cylinder and between the end of the piston and the cylinder for reducing the shock effects of the displacement of the lower frame toward the upper frame.

9. In the improved structure of claim 2 and further comprising means carried by the latch bar for disengaging the notch in the rod member with the slot in the cross member on substantially full displacement of the lower frame toward the upper frame.

10. A cot structure for transporting medical patients and the like comprising:

an upper frame structure;

a lower frame structure;

pivotally mounted connecting members extending between the upper frame structure and the lower frame structure and connected thereto to permit a relative extension of the two frame structures away from each other as well as a relative retraction of the two frame structures toward each other;

first latch means carried by the cot structure for holding the relative position of the upper and lower frame structures as adjusted and spaced apart by the pivotally mounted connecting means; and means carried by the cot for exerting a retracting force against the connecting members to effect a retraction of the lower frame structure toward the upper frame structure.

11. The structure as set forth in claim 10, wherein the last-mentioned means includes at least one compression spring and second latch means for retaining said compression spring in a preloaded conformation.

12. The structure as set forth in claim 11 and further comprising means carried by the cot structure for releasing the first latch means after pre-loading of the spring to allow retraction of the lower frame structure toward the upper frame structure.

13. The structure as set forth in claim 12, together with means associated with the first latch means to effect de-latching of the second latch means after retraction has been completed.

14. The structure as set forth in claim 13, together with dampening means for controlling the rate of retraction of the two frame structures relative to each other.

15. The structure as set forth in claim 14, wherein the dampening means is of compression spring and hydraulic fluid type.

16. The structure as set forth in claim 14, wherein the dampening means is of pneumatic type.

17. The structure as set forth in claim 16, wherein the pneumatic type dampening means includes a pneumatic compression cylinder, a movable piston rod slidable therewithin, a one way valve associated with the compression chamber of the pneumatic cylinder, and an air limit orifice also associated therewith.

18. The structure as set forth in claim 14, together with at least one handle means connected to the compression spring mechanism for effecting the pre-loading thereof, and at least one handle structure connected to the first latch means for manual actuation thereof by a user of the cot.

19. The structure as set forth in claim 18, together with the lower frame structure being provided with rollable wheels thereon for permitting easy movement of the device from one place to another.

20. The structure as set forth in claim 18, together with upper frame structure attachment devices for preventing accidental fall out of a patient when supported thereby, and additional means provided on said upper structure for making the patient more comfortable.

* * * * *